US011186945B1

(12) United States Patent
O'Bryan et al.

(10) Patent No.: US 11,186,945 B1
(45) Date of Patent: Nov. 30, 2021

(54) SURFACE TREATMENT OF ULTRA-HIGH MOLECULAR WEIGHT POLYMERS

(71) Applicant: National Technology & Engineering Solutions of Sandia, LLC, Albuquerque, NM (US)

(72) Inventors: Greg O'Bryan, Livermore, CA (US); Mitchell Anstey, Davidson, NC (US); Bryan Loyola, San Jose, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 752 days.

(21) Appl. No.: 15/690,687

(22) Filed: Aug. 30, 2017

(51) Int. Cl.
*D06M 13/322* (2006.01)
*D06M 101/20* (2006.01)

(52) U.S. Cl.
CPC ..... *D06M 13/322* (2013.01); *D06M 2101/20* (2013.01); *D06M 2400/01* (2013.01)

(58) Field of Classification Search
None
See application file for complete search history.

(56) References Cited

U.S. PATENT DOCUMENTS 5,342,567 A 8/1994 Chen et al.
2015/0087848 A1* 3/2015 Oyola ..... C07D 307/48 549/488

FOREIGN PATENT DOCUMENTS

CN 106120300 * 11/2016

OTHER PUBLICATIONS

Azo Materials https://www.azom.com/article.aspx?ArticleID=854 (Year: 2019).*
Boaen et al. ("Post-polymerization Functionalization of Polyolefins", Chem Soc Review, 34, 267-275, 2005). (Year: 2005).*
Machine translation of CN106120300, Jiang et al. (Year: 2016).*
Visjager, Jeroen Franklin, "Ultra-High Molecular Weight Polymers: Processing and Properties of Polyethylene and Poly(tetraflouroethylene)", A Dissertation submitted to the Eidgenossische Technische Hochschule Zurich, 2001, 141 pages.
Strem Chemicals, Inc., "Rh2(DOSP)4 and Rh2(PTAD)4: C—H Activation by Means of Metal-Carbenoid-Induced C—H Insertion", Retrieved Date: Sep. 22, 2016, pp. 1-2.
Torquato et al., "Functionalizing the Surface of Polyethylene," Jul. 1, 2015 (1 pp.), available at https://www.osti.gov/scitech/biblio/1279676 (last accessed Nov. 1, 2017).

* cited by examiner

*Primary Examiner* — Shawn Mckinnon
(74) *Attorney, Agent, or Firm* — Medley, Behrens & Lewis, LLC

(57) ABSTRACT

The methods and compounds disclosed herein relate to the surface modification of UHMWPs by means of a catalytic C—H bond insertion catalyst using a rhodium catalysts in conjunction with carbene-generating diazo compounds. The catalytic treatment imparts covalently added functionality to the UHMWPE surface. This functionality acts as an excellent grafting mechanism for grafting, bonding, or adhering further materials to the UHMWPs surface.

20 Claims, 2 Drawing Sheets

SURFACE TREATMENT OF ULTRA-HIGH MOLECULAR WEIGHT POLYMERS

GOVERNMENT RIGHTS

This invention was made with Government support under Contract No. DE-NA0003525 awarded by the United States Department of Energy/National Nuclear Security Administration. The U.S. Government has certain rights in the invention.

BACKGROUND

Ultra-high molecular weight polyolefins (UHMWPs), such as polyethylene (UHMWPE) are polymers with molecular weights exceeding 1,000,000 grams per mole. Commercially they are available as high strength fibers. UHMWPE has excellent abrasion resistance and typically the highest impact toughness of all polymer materials. It has a high stress crack resistance and a low coefficient of surface friction.

Several challenges exist in processing and utilizing UHMWPs. They generally have high melt viscosity and generally lack reactivity. In particular UHMWPE is very difficult to bond with other materials due to a very low surface energy. This makes surface modifications or adhesion to UHMWPE materials very difficult. High quality composite structures of UHMWPE with other materials are thus difficult to achieve.

SUMMARY

The methods and compounds disclosed herein relate to the surface modification of UHMWPs by means of catalytic C—H bond insertion chemistry using rhodium catalysts in conjunction with carbene-generating diazo compounds. The catalytic treatment imparts covalently added functionality to the UHMWPE surface. This functionality acts as an excellent mechanism for grafting, bonding, or adhering further materials to the UHMWPs surface.

After functionalization, the surface of the treated material can then be readily modified to match chemistry of common resin systems. This allows for substantial improvement in adhesion between the materials, offering the ability to make highly resilient composite structures.

DETAILED DESCRIPTION

Figure 1:
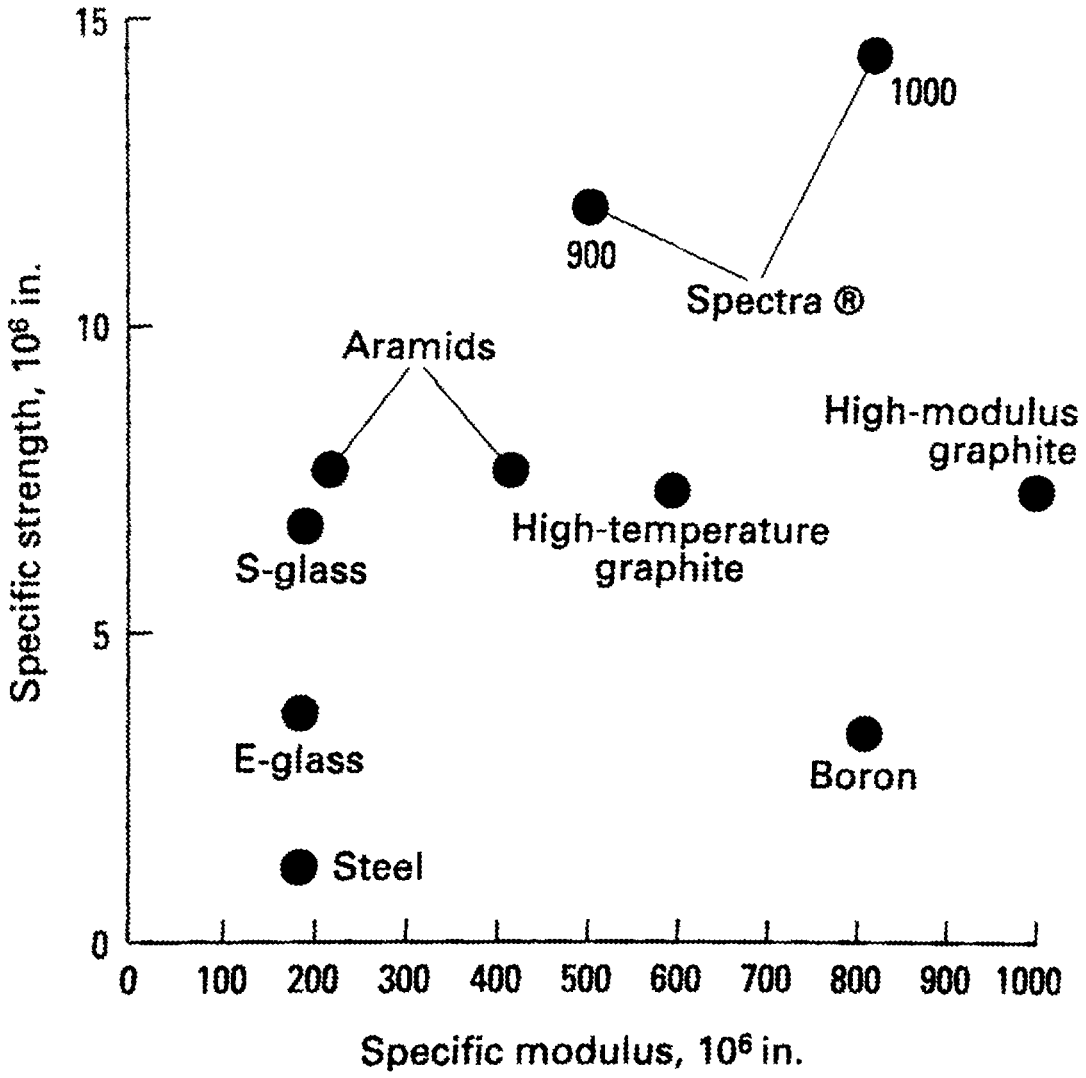
FIG. 1 is a graph showing a comparison of typical fiber filler strengths.

Various technologies pertaining to ultra-high molecular weight polymers (UHMPs), are now described. In the following description, for purposes of explanation, numerous specific details are set forth in order to provide a thorough understanding of one or more aspects. It may be evident, however, that such aspect(s) may be practiced without these specific details. While this disclosure focuses mainly on ultra-high molecular weight polyethylene (UHMWPE), the teachings are believed to be applicable to other ultra-high molecular weight polyolefins (UHMWPs).

The application of carbon-hydrogen (C—H) bond insertion chemistry to incorporate chemical functionality into UHMWPE is utilized as disclosed herein. Unlike other methods of modifying UHMWPs this is done in a manner that does not compromise polymer integrity. UHMWPE is a variation of traditional polyethylene plastics in that the molecular weight of polymer chains are typically a million Daltons or more. The increase in molecular weight expands the load transfer ability of the material through a higher order of inter-chain entanglement. The completely saturated aliphatic backbone structure of polyethylene imparts very low chemical reactivity and low surface energy. These properties limit the use of UHMWPE in composite manufacture through a decreased ability to wet the surface and for matrix materials to adhere to fibers, this causes delamination and decreases the ultimate yield strength of the composite.

Current methods for polymeric surface treatment on UHMWPE are performed through destructive methods, such as oxidizing chemical baths, free radical chemistry, plasma treatment, and electrical etching (corona discharge), each of which degrade the polymer structure and/or limit its ultimate strength. These methods are also non-specific and utilize toxic chemicals. The adhesion is still weaker than glass and carbon fiber.

Through the catalysis and additive chemical functionalization methods disclosed herein improvements in reactivity at the UHMWPE material surface can be improved. Even modest improvements have a large impact on wettability and bonding, as well as providing a route to physically (covalently) tether resins to the material surface. In contrast to other methods the materials disclosed herein maintain or improve other properties of material.

The methods disclosed herein relate to a post-polymerization functionalization of an already formed polymeric polyolefinic material. The methods disclosed herein use transition metal catalysis and highly reactive carbenes to directly impart chemical functionalization to UHMWPs. In doing so, the method maintains the integrity of the fiber, limits side reactions, can be highly specific and tunable to match surface chemistry with a selected secondary material, and is done with non-toxic reagents.

In an embodiment, the surface of the material is primarily treated, not the interior of the material. Thus, the functional group density can be concentrated on the outer surface of the material, whether it be a bulk plastic, woven material, yarn, or fiber.

Reaction scheme (I) shows an embodiment of the method of functionalizing the UHMWP material.

Reaction scheme I

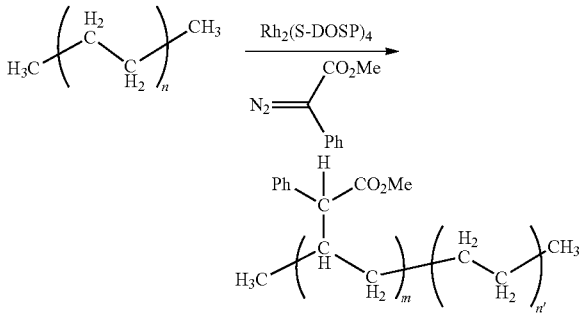

In this exemplary scheme, the UHMWP starting material is on the left and n may range from 70,000 to 700,000, which equates to a Mw of about 1,000,000 to 10,000,000. In this embodiment, the catalyst is a rhodium catalyst, tetrakis[(S)-

(+)-N-(p-dodecylphenylsulfonyl)prolinato]dirhodium(II) ($Rh_2$(S-DOSP)$_4$). Along with the catalyst, a diazo ester compound, methyl phenodiazoacetate, is added to the material in solution, e.g., in a non-polar solvent, such as hexane, optionally with heating to produce a reaction. The end product results from a C—H insertion on one or more backbone carbons of the polymer chain. The end product is functionalized with the phenyl ester compound with evolution of $N_2$ gas as a byproduct. The variable n' is defined as the units n that remain unfunctionalized in the final product, and the variable m is defined as the units n that were chemically modified in the reaction.

Generally, the degree of functionalization of the polymer (i.e, the number of functional groups added to the polymer) is affected by several factors, such as, for example, the size of carbene formed from the catalyst and diazo compound, the amount of carbene formed, and crosslinking of the polymer. The theoretical limit is all of the $CH_2$ units can be functionalized. The variable n' is defined as the units n that remain unfunctionalized in the final product, and the variable m is defined as the units n that were chemically modified in the reaction. In an embodiment, m+n'=n and the ratio m:n' is, for example, 1: 10-700,000, such as 1: 100-10,000, or 1:50,000 to 650,000. The variable m may be, for example, 1 to 1,000,000, such as 10 to 10,000, or 50 to 200. These values may be generalized to other embodiments as well.

A generalized catalytic reaction cycle of an embodiment of the method is shown in Reaction Scheme II. Reaction scheme II is a generalized example of the specific reaction scheme I. In Reaction Scheme II: (1) corresponds to the product in Scheme I; (2) is a transition metal (M) with n organic ligands (L) complex that corresponds to the Rhodium catalyst in Scheme I; (3) is a diazo group containing compound corresponding to the diazo ester compound in Scheme I; (4) corresponds to the unfunctionalized starting material polyolefin in Scheme I; and (5) corresponds to a reactive transition metal complex intermediate in Scheme I. The variables, $R_1$, $R_2$, L, and M are discussed further below. The bonds that are shown in 1 and 4 with no atoms on the end are short hand representations and should be considered to be two bonds leading to other carbons on the backbone of the polymer, with the other bond leading to a hydrogen atom.

Reaction Scheme II

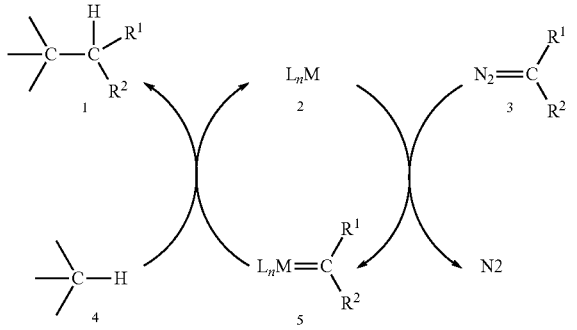

Not wishing to be bound by theory, the catalytic C—H bond insertion of transition metal complex 5 into the hydrocarbon bond of the polymer 4, occurs as follows. The diazo group-containing compound 3 reacts with transition metal complex 2 to generate the intermediate carbene complex 5. Carbene complex 5 then directly inserts into a carbon-hydrogen bond of polymer substrate 4, regenerating transition metal complex 2 and yielding functionalized UHMWP product 1, with a chemically modified polymeric backbone carbon. The arrows in Reaction Scheme II indicate a catalytic cycle (a catalyst being the compound that performs a chemical reaction many times, over and over again, consuming and producing reagents as it goes).

Light or gentle heating is applied to the reaction to raise the solution to the activation temperature of the diazo group-containing compound 3 to form a carbene. However, once the active form of the catalyst is created energy from heating or light is not required to produce the chemical addition to the polymer. After that the solution is cooled to room temperature or below to control and limit the reactivity of the 5 to 1 C—H insertion step.

The end result of this chemical treatment is a linkage of an ester moiety to polyethylene polymer chains. This provides a reactive site, which can be used to further tailor the polymer chemistry of the fiber surface. Ultimately a new covalent bond between 3 and 4 is established with evolution of $N_2$ gas as a byproduct.

The base unfunctionalized polymerized material, i.e. compound (4) in Reaction Scheme III, includes polyolefins that have weight average molecular weights (Mw) from 150,000 to 10,000,000, such as, for example, UHMWPs, having an Mw of 1,000,000 to 10 million, 1.25 million to 5 million, or 1.5 million to 3.5 million. The methods may also be applied to polyolefins having a lower Mw, such as 150,000 to 500,000, 200,000 to 450,000, or 250,000 to 400,000. However, UHMWPs are the primary target of the methods disclosed herein because of the difficulties with functionalizing and improving the reactivity and adhesion of these low surface energy materials. In contrast, to other destructive methods of functionalizing or improving reactivity of UHMWPs, the method disclosed herein maintains substantially the same Mw after functionalization, e.g., the Mw of the functionalized polymer material does not drop by more than 0.1 or 1% after functionalization, and generally is about the same or higher (due to the added functional group(s)). In an embodiment, the surface energy of the functionalized polyolefinic material is increased in comparison to a non-functionalized polyolefinic material of the same type. A yield strength as determined by ASTM 638-14 of the functionalized polyolefinic material is the same within the bounds of experimental error as compared to the yield strength of a non-functionalized polyolefinic material of the same type.

In an embodiment, the UHMWP advantageously is a highly linear polymer. Linear chains allow for a substantial amount of crystallinity (35 to 80% crystallinity, such as 40 to 75%, or 50 to 65%) that is encompassed by regions of amorphous polymer entanglements. Crystalline regions provide high modulus, while the amorphous regions impart high strength and tenacity. Combining these two features in a "brick and mortar" style structure allows the material to rearrange in a dramatic fashion when under high energy deformation. Uniquely, such UHMWPE fibers show increased resistance to repeated tensile stress, so the material becomes stronger after being exposed to strain. In an embodiment, the UHMWPE material has highly ordered filaments with crystal segments separated by amorphous regions. The base polymer may, for example, be in a bulk plastic, woven material, yarn, or fiber.

Examples of commercial UHMWPE materials include SPECTRA 900 or 1000 by HONEYWELL, and DYNEEMA or DSM DYNEEMA (in various grades). FIG.

1 is a graph showing a comparison of typical fiber filler strengths including a SPECTRA material.

Desirable attributes for the base material that will be functionalized and the final functionalized material, or final composite material that should retain at least the same property level or an improved level (such as 0.1% to 100%, 1% to 50%, or 3% to 10% over the unfunctionalized base material) after functionalization are as follows:

(1) High tensile modulus, such as, for example, 50 GPa to 400 GPa, such as 60 GPa to 200 GPa, or 65 GPa to 125 GPa. Tensile modulus may be measured by ASTM D638-14 for bulk plastics or ASTM C1557-14 for fibers.

(2) High tensile strength, such as, for example, 2 to 10 GPa, such as, 2.5 to 5 GPa, or 3 to 4 GPa for fibers or 18 to 70 MPa, such as, 20 to 60 MPa, or 35 to 50 MPa for bulk materials. Tensile strength for polymeric materials disclosed herein may be determined by ASTM D638-14 for bulk plastics or ASTM C1557-14 for fibers.

(3) Relatively low density, such as, for example, 0.7 to 1.4 g/cm$^3$, 0.9 to 1.3 g/cm$^3$, or 0.9 to 1.0 g/cm$^3$. This compares to 1.44 g/cm$^3$ for Kevlar, which indicates that the materials disclosed herein are lighter than Kevlar with similar strength. Density of a polymeric materials disclosed herein can be determined by ASTM D1505-10.

Further properties and comparisons with other materials are disclosed in Table 1.

TABLE 1

| Materials | Density (g * cm$^{-1}$) | Tensile Modulus (GPa) | Tensile Strength (GPa) | Specific Tensile Strength (Gpa * $\rho^{-1}$) | Ultimate Elongation (%) |
|---|---|---|---|---|---|
| SPECTRA1000 | 0.97 | 113 | 3.25 | 3.35 | 2.9 |
| IM6 Carbon Fiber HEXCELL | 1.76 | 279 | 5.72 | 3.25 | 1.9 |
| E-Glass | 2.58 | 72 | 3.45 | 1.34 | 4.8 |
| S-2-Glass | 2.46 | 87 | 4.89 | 1.99 | 5.7 |
| Kevlar 49 | 1.44 | 112 | 0.525 | 0.365 | 3.6 |

In an embodiment, the catalyst $L_nM$ (as shown in Reaction Scheme II as compound (2)) is a transition metal complex with n organic ligands. M is Rhodium, L is an organic ligand, and the variable n may be, for example, 2 to 10, 3 to 8, or 4 to 6. The transition metal M includes single and multiple atoms, such as 1 to 8, or 2 to 4 atoms. The organic ligands, may be selected from: tetrakis[(S)-(+)-N-(p-dodecylphenylsulfonyl)prolinato and tetrakis[(R)-(−)-(1-adamantyl)-(N-phthalimido)acetato coordinating materials.

In an embodiment, Rhodium (II) is the metal selected for the catalyst, and $L_nM$ is a di-Rhodium complex. Particular dirhodium complex catalysts that may be used comprise: Tetrakis[(S)-(+)-N-(p-dodecylphenylsulfonyl)prolinato] dirhodium(II) ($Rh_2$(S-DOSP)$_4$), Tetrakis[(R)-(+)-N-(p-dodecylphenylsulfonyl)prolinato]dirhodium(II) ($Rh_2$(R-DOSP)$_4$) Tetrakis[(R)-(−)-(1-adamantyl)-(N-phthalimido) acetato]dirhodium(II) ($Rh_2$(R-PTAD)$_4$), and Tetrakis[(S)-(−)-(1-adamantyl)-(N-phthalimido)acetato]dirhodium(II) ($Rh_2$(S-PTAD)$_4$).

The diazo group-containing compound ((3) from Reaction Scheme II) generally corresponds to the formula $N_2{=}C(R^1)(R^2)$. $R^1$ may be selected from H or alkyl groups. $R^2$ may be selected from a polar group, such as, for example, an ester or amide. In an embodiment, the alkyl groups may be linear, branched, aromatic, cyclic, or aliphatic groups, and include 1 to 20 carbon atoms, such as 3 to 12, or 4 to 8. The ester group may be defined as —C(O)O—$R^3$ wherein $R^3$ is H or an alkyl group as defined for $R^1$. The amide is defined as -E(O)$_x$N($R^4$)($R^5$), wherein $R^4$ and $R^5$ are independently selected from H or alkyl groups as defined above for $R^1$; 1 or 2; E is C, P, or S; and x is 1 or 2. The amide is an organic amide, wherein E is C, and x is 1), a phosphoramide, wherein E is P, and x is 1, or a sulfonamide, wherein E is S, and x is 2.

The functionalizing diazo compound and catalyst should be selected so that they will form a reactive carbene that performs carbon hydrogen insertion on the selected polymer.

The functional group that is inserted into the polymer will be a derivative of the functionalizing diazo group containing compound $N_2{=}C(R^1)(R^2)$. The surviving functional group on the polymer will be —CH($R^1$)($R^2$) (see functionalized polymer (1) in Reaction Scheme II). The conversion of the functionalizing diazo group containing compound to the functional group on the polymer is explained by the mechanism in Reaction Scheme II. An exemplary functional group is methyl phenyl acetate (as shown in Reaction Scheme I) where $R^1$ is a phenyl group and $R^2$ is a methyl ester group. Other functional groups include those where $R^1$ is selected from H or alkyl groups and $R^2$ is selected from a polar group, such as, for example, an ester or amide. In an embodiment, the alkyl groups may be linear, branched, aromatic, cyclic, or aliphatic groups, and include 1 to 20 carbon atoms, such as 3 to 12, or 4 to 8. The ester group is defined as —C(O)O—$R^3$, wherein $R^3$ is H or an alkyl group as defined for $R^1$. The amide is defined as -E(O)$_x$N($R^4$)($R^5$), wherein $R^4$ and $R^5$ are independently selected from H or alkyl groups as defined above for $R^1$; 0, 1 or 2; E is C, P, or S; and x is 1 or 2. The amide may be an organic amide, wherein E is C, and x is 1), a phosphoramide, E is P, and x is 1, or a sulfonamide, wherein E is S, and x is 2.

Due to the non-destructive post-polymerization functionalization conditions, the final functionalized polymer (1 in Reaction Scheme II) generally maintains the high molecular weight of the base polymer. In an embodiment, the Mw does not drop by more than 1% after functionalization, and generally is the same or higher (due to the added functional group(s)). The other properties listed above for the base (unfunctionalized) polymer should also be maintained after functionalization, e.g., within 5% or 3% of their original values.

In an embodiment, functional groups are added at a stoichiometric ratio of 0.01% to 20% by weight percent of the Mw of the polyolefin chain, such as 0.05% to 10%, or 0.1% to 1%. Even a small amount of functionalization will dramatically improve wettability and reactivity of the polymer chain.

In an embodiment, the functional group on the polyolefinic material forms a moiety for a secondary functionalization and an exemplary method further comprising performing a secondary functionalization on the functional group. In an embodiment, the UHMWP has been made significantly more reactive than the previously unfunctionalized material and this opens up many more reactions and functional groups that can be added to the material at the functionalized site.

Example secondary functional groups that may be added include, for example, carboxylic acids, epoxide moieties, or amino and hydroxyl groups. These may be added by hydrolysis or trans-estrification reactions. In an embodiment, the secondary functionalization is performed so that the UHMWP material can be directly bonded to a secondary material without adhesive. In an embodiment, the secondary functionalization is performed so that the UHMWP material is more compatible with a particular adhesive, i.e. has a stronger bond.

Materials that may be fabricated with the functionalized polymeric material disclosed herein include a functionalized bulk plastic, fiber, yarn, or woven material. Such functionalized materials may then be utilized alone or may be adhered with an adhesive to a secondary material or otherwise may be directly bonded to a secondary material. The functional group imparted to the polymer in the methods disclosed herein may be selected to interact with the secondary material and/or the adhesive.

Secondary materials may include, for example, polymeric resins of various types, such as phenolic or hydroxyl functionalized polyols, alkyl and aromatic diamines, and diisocyanate containing materials.

Adhesives for use with the functionalized polymer include those such as epoxies, polyurethanes, vinyl esters, polyesters, polyamides, and phenolics. The adhesive may be applied by rolling, spraying, brushing or other methods of coating to the functionalized material.

The composite materials may comprise the secondary material layered over a layer of the functionalized material, such as a sheet-over-sheet construction (optionally with a tie or adhesive layer in between). In another embodiment, the functionalized material may be fully or partially coated with the secondary material, such as, for example, a functionalized yarn coated with the secondary material. In an embodiment, the secondary material fully encapsulates the surface of the functionalized material. The secondary material coating may comprise a thin film or a thicker coating that has a greater thickness than the yarn, fiber, bulk, or woven material. In another embodiment, the secondary material may comprise materials with antibiotic or antibacterial properties.

Example articles that may comprise the functionalized and secondary material are body armor, vehicle armor, composite cylindrical materials (e.g. rope or cable), sails, parachutes, and medical implants, such as, for example, hip or other joint implants.

EXAMPLE

The reaction described below was performed in a glovebox to control the atmospheric conditions.

A 20 mL reaction vial was charged with a stir bar, a swatch of pre-woven UHMWPE fabric (0.1780 g, 12.69 mmol), and the selected rhodium catalyst ($(C_{23}H_{30}NO_4S)_4Rh_2$, 0.024 g, 0.013 mmol).

Roughly 5 mL of dimethylbutane was added to completely immerse the swatch. A separate second vial was charged with ethyl-2-diazoacetate (0.5 g, 4.38 mmol) and 2 mL of dimethylbutane.

The contents of the second vial was taken up into a 2 mL syringe and added via syringe pump to the contents of the reaction vial at a rate of 0.00167 mL/min and left for about 20 hr for complete addition.

The fabric was removed and washed five times each (about 15 mL per rinse) with the following solvents in the listed order: dichloromethane, hexane, acetone, water, and acetone.

The fabric was placed in a vacuum chamber and dried at ambient temperature, under reduced pressure for 30 minutes prior to analysis.

Figure 2:
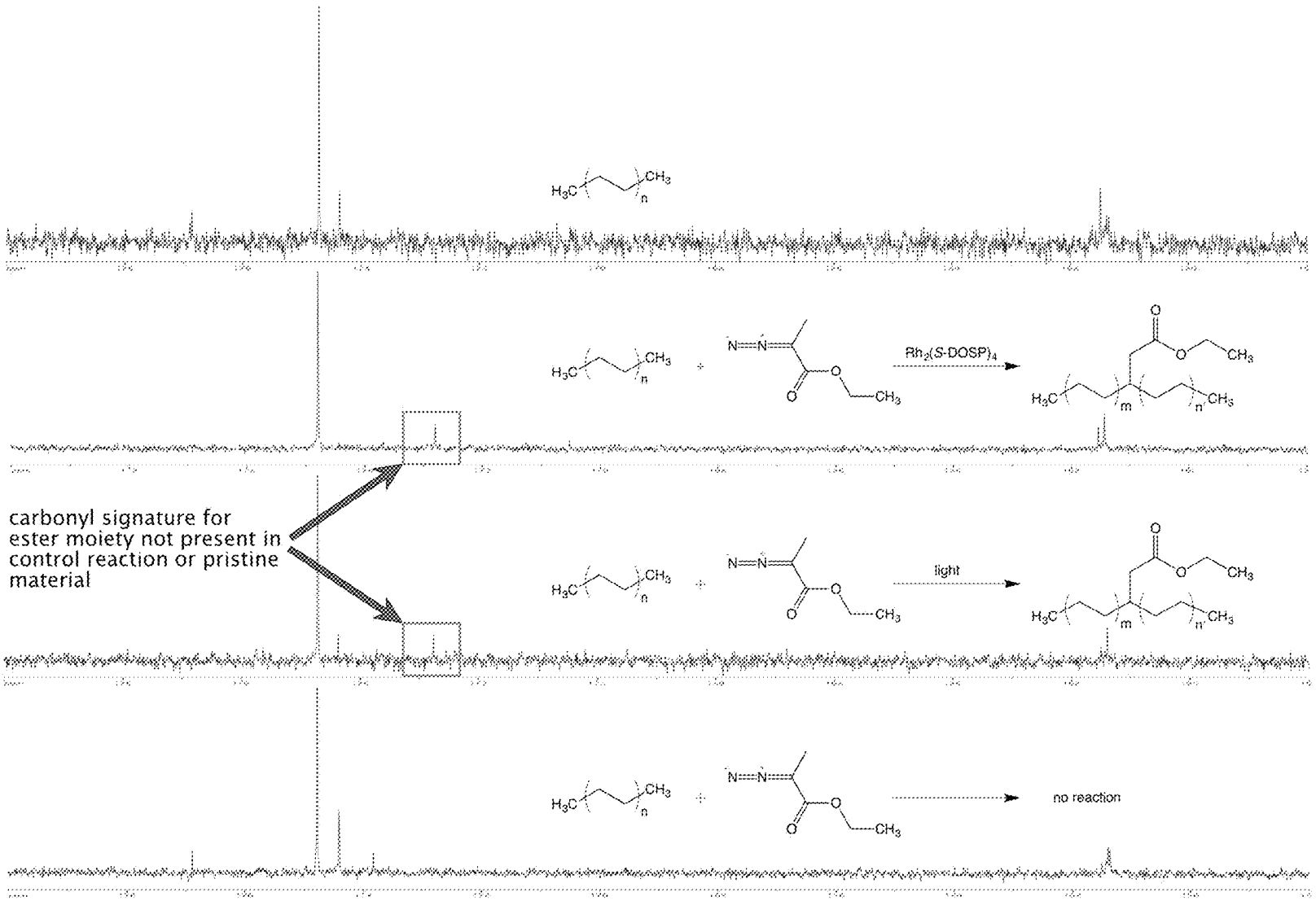
FIG. 2 is an annotated NMR spectra corresponding to Example 1.

The fabric swatch was then analyzed by carbon and proton nuclear magnetic resonance (NMR) and on representative polyethylenes which could be dissolved into an appropriate deuterated solvent for analysis. The NMR spectra is shown in FIG. 2 and as shown in the annotations, indicated that the functionalized polymer had successfully formed.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim. The term "consisting essentially" as used herein means the specified materials or steps and those that do not materially affect the basic and novel characteristics of the material or method. All percentages and averages are by weight unless the context indicates otherwise. If not specified above, the properties mentioned herein may be determined by applicable ASTM standards, or if an ASTM standard does not exist for the property, the most commonly used standard known by those of skill in the art may be used. The articles "a," "an," and "the," should be interpreted to mean "one or more" unless the context indicates the contrary.

It is claimed:

1. A method comprising:

reacting a polyolefinic material with a rhodium catalyst; and a diazo group containing compound defined as $$N_2C(R^1)(R^2)$$

to form a functionalized polyolefinic material with a functional group bonded to the backbone of the polyolefin chain, the functional group defined as $$—CH(R^1)(R^2)$$

wherein $R^1$ is an alkyl group and $R^2$ is a polar group;

wherein the polar group is an ester or an amide;

wherein the alkyl group of $R^1$ is selected from linear, branched, aromatic, cyclic, or aliphatic groups, and the alkyl group has 1 to 20 carbon atoms;

wherein the functionalized polyolefinic material is an ultra high molecular weight polyolefin, having a weight-average molecular weight of 1,000,000 to 10,000,000 g/mol.

2. The method of claim 1, wherein the weight-average molecular weight of the functionalized polyolefinic material is no less than 1% lower than the weight-average molecular weight of the polyolefinic material prior to the reacting step.

3. The method of claim 1, wherein the polyolefinic material is a thread, yarn, or woven material.

4. The method of claim 1, wherein the polar group is an ester or an amide.

5. The method of claim 4, wherein the polar group is an ester or an amide;

wherein the ester group is defined as $—C(O)O—R^3$, wherein $R^3$ is H or an alkyl group selected from linear, branched, aromatic, cyclic, or aliphatic groups, and the alkyl group 1 to 20 carbon atoms; and the amide is defined as $-E(O)_xN(R^4)(R^5)$, wherein $R^4$ and $R^5$ are independently selected from H or an alkyl group selected from linear, branched, aromatic, cyclic, or aliphatic groups, and the alkyl group has 1 to 20 carbon atoms, E is C, P, or S and x is 1 or 2.

6. The method of claim 1, wherein the functional group forms a moiety for a secondary functionalization and further comprising performing a secondary functionalization on the functional group.

7. The method of claim 1, further comprising directly bonding the functionalized polyolefinic material to a secondary material or adhering the functionalized polyolefinic material to a secondary material with an adhesive.

8. A material comprising:

a functionalized polyolefinic material including a functional group bonded to the backbone of the polyolefin chain, the functional group defined as $$—CH(R^1)(R^2)$$

wherein $R^1$ is an alkyl group and $R^2$ is a polar group;

wherein the polar group is an ester or an amide;

wherein the functionalized polyolefinic material is an ultra-high molecular weight polyolefin, having a weight-average molecular weight of 1,000,000 to 10,000,000 g/mol;

wherein the alkyl group of $R^1$ is selected from linear, branched, aromatic, cyclic, or aliphatic groups, and the alkyl group has 1 to 20 carbon atoms.

9. The material of claim 8, wherein the functionalized polyolefinic material is polyethylene.

10. The material of claim 8, wherein the polar group is an amide.

11. The material of claim 8, wherein the polyolefinic material is a thread, yarn, or woven material.

12. The material of claim 8, further comprising a secondary material, the secondary material being directly bonded or adhered with an adhesive to the functionalized polyolefinic material.

13. The material of claim 8, wherein the material is body or vehicle armor.

14. The material of claim 12, wherein the secondary material comprises a material with antibiotic or antibacterial properties.

15. The material of claim 8, wherein the surface energy of the functionalized polyolefinic material is increased in comparison to a non-functionalized polyolefinic material of the same type and a yield strength as determined by ASTM 638-14 of the functionalized polyolefinic material is the same within the bounds of experimental error as compared to the yield strength of a non-functionalized polyolefinic material of the same type.

16. A material comprising:

a functionalized polyolefinic material including a functional group bonded to the backbone of the polyolefin chain, the functional group defined as $$—CH(R^1)(R^2)$$

wherein $R^1$ is an alkyl group and $R^2$ is a polar group;

wherein the functionalized polyolefinic material is an ultra-high molecular weight polyolefin, having a weight-average molecular weight of 1,000,000 to 10,000,000 g/mol wherein the alkyl group of $R^1$ is selected from linear, branched, aromatic, cyclic, or aliphatic groups, and the alkyl group has 1 to 20 carbon atoms, and the polar group is an ester or an amide;

wherein the ester group is defined as $—C(O)O—R^3$, wherein $R^3$ is H or an alkyl group selected from linear, branched, aromatic, cyclic, or aliphatic groups, and the alkyl group 1 to 20 carbon atoms; and the amide is defined as $-E(O)_xN(R^4)(R^5)$, wherein $R^4$ and $R^5$ are independently selected from H or an alkyl group selected from linear, branched, aromatic, cyclic, or aliphatic groups, and the alkyl group has 1 to 20 carbon atoms, E is C, P, or S and x is 1 or 2.

17. The material of claim 16, further comprising a secondary material, the secondary material being directly bonded or adhered with an adhesive to the functionalized polyolefinic material.

18. The material of claim 17, wherein the secondary material comprises a material with antibiotic or antibacterial properties.

19. The material of claim 16, wherein the amide is defined as $-E(O)_xN(R^4)(R^5)$, wherein $R^4$ and $R^5$ are independently selected from H or an alkyl group selected from linear, branched, aromatic, cyclic, or aliphatic groups, and the alkyl group has 1 to 20 carbon atoms, E is C, P, or S and x is 1 or 2.

20. The material of claim 8, wherein the amide is defined as $-E(O)_xN(R^4)(R^5)$, wherein $R^4$ and $R^5$ are independently selected from H or an alkyl group selected from linear, branched, aromatic, cyclic, or aliphatic groups, and the alkyl group has 1 to 20 carbon atoms, E is C, P, or S and x is 1 or 2.

* * * * *